US007329042B2

(12) United States Patent
Hiranuma et al.

(10) Patent No.: US 7,329,042 B2
(45) Date of Patent: Feb. 12, 2008

(54) WATCH CROWN WITH ANTI-ROTATION GASKET

(75) Inventors: Haruki Hiranuma, Chiba (JP); Kinshuroh Itoh, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/542,994

(22) Filed: Oct. 4, 2006

(65) Prior Publication Data

US 2007/0076532 A1 Apr. 5, 2007

(30) Foreign Application Priority Data

Oct. 5, 2005 (JP) ..... 2005-292007

(51) Int. Cl.
*G04B 37/00* (2006.01)

(52) U.S. Cl. ..... 368/308; 368/319

(58) Field of Classification Search ..... 368/308, 368/288–290, 320–321, 319
See application file for complete search history.

(56) References Cited

U.S. PATENT DOCUMENTS 3,357,173 A * 12/1967 Wyssen ..... 368/190
3,362,154 A * 1/1968 Perret ..... 368/290
3,389,550 A * 6/1968 Piquerez ..... 368/308
5,742,565 A * 4/1998 Cuinet et al. ..... 368/190
7,118,270 B2 * 10/2006 Hiranuma et al. ..... 368/289

* cited by examiner

*Primary Examiner*—Vit Miska
*Assistant Examiner*—Sean Kayes
(74) *Attorney, Agent, or Firm*—Adams & Wilks

(57) ABSTRACT

There is provided a watch in which a crown and associated parts, excluding a winding stem pipe, can be replaced when the screw locking function is impaired. The watch includes a case band having a pipe attachment hole, a winding stem pipe, a ring gasket made of elastic resin material, a ring, and a crown. The winding stem pipe is inserted into the pipe attachment hole and fixed to the case band in a liquid tight manner. Outer grooves are formed on the outer cylindrical surface of an off-case band projection of the winding stem pipe that is disposed outside the case band. The removable gasket is fitted on and in close contact with the outer cylindrical surface of the off-case band projection such that the outer grooves prevent the rotation of the gasket. The ring has a male screw formed on the outer cylindrical surface thereof and inner grooves formed on the inner cylindrical surface thereof. The ring is removably fitted on the outer cylindrical surface of the gasket. The gasket is compressed and sandwiched between the ring and the off-case band projection such that the inner grooves prevent the rotation of the gasket. The crown removably engages the male screw of the ring.

5 Claims, 5 Drawing Sheets

WATCH CROWN WITH ANTI-ROTATION GASKET

BACKGROUND OF THE INVENTION

1. Field of the Invention

The present invention relates to a watch with a structure that holds a crown and prevents accidental rotation of the crown.

2. Description of the Prior Art

Some of watches have a structure that locks a crown using screw engagement to prevent accidental rotation of the crown when the watch is worn on the wrist (this structure is hereinafter referred to as "screw lock" or "screw locking structure").

The screw locking structure is configured such that a winding stem pipe is attached to a case band having a built-in watch movement and a male screw formed on the outer cylindrical surface of a projection disposed outside the case band (hereinafter referred to as "off-case band projection") of the pipe engages a female screw formed on a crown main portion that fits on the off-case band projection. In a normal operation, this arrangement allows the crown to be locked by engaging the crown main portion with the outer cylindrical surface of the off-case band projection. To perform some operations on the watch movement, the wearer disengages the crown main portion from the male screw, pulls the crown out, and rotates the winding stem accommodated inside the winding stem pipe.

In a conventional watch with such a screw locking structure, watertightness of the portion where the winding stem pipe is attached is generally achieved by brazing the winding stem pipe to the case band (see the JP-A-57-46181, for example).

Another type of watches, which is known in the art, achieves watertightness of the portion where the winding stem pipe is attached by forming a second male screw on the winding stem pipe that is different from the male screw that engages the crown, engaging the second male screw with a female screw formed on a pipe attachment hole in the case band, and sandwiching a watertight gasket between the case band and the winding stem pipe when the screws engage with each other (see the JP-A-2004-245594, for example).

In a watch with a screw locking structure, the female screw of the crown and the male screw of the winding stem pipe that engage with each other may be worn or scraped due to repeated rotation of the crown. This will impair the function of locking the crown, so-called screw locking function.

When such a situation arises, in the watch according to the JP-A-57-46181 in which the winding stem pipe is brazed to the case band, the crown and associated parts cannot be replaced because the replacement involves removal of the winding stem pipe from the case band. Accordingly, the entire watch enclosure assembly including the case band has to be replaced and there is a need to improve this replacement procedure.

In the watch according to the JP-A-2004-245594 in which the winding stem pipe is screwed into the case band, it is believed, in principle, to be able to replace the crown and associated parts including the winding stem pipe. However, every time the crown is engaged with and disengaged from the winding stem pipe, rotational force acts on the winding stem pipe, which may loosen the engagement between the winding stem pipe and the case band and result in reduced watertightness of the watertight gasket.

To overcome the above problem, an adhesive may be filled in the portion where the winding stem pipe and the case band engage with each other. In this case, i.e., when the engagement portion is bonded by an adhesive, it is difficult to remove the winding stem pipe from the case band and practically impossible to replace the crown and associated parts. Accordingly, when the screw locking function is impaired, the entire watch enclosure assembly including the case band has to be replaced and there is a need to improve this replacement procedure.

SUMMARY OF THE INVENTION

An object of the invention is to provide a watch in which the crown and associated parts, excluding the winding stem pipe, can be replaced when the screw locking function is impaired.

To solve the above problem, the watch according to the invention comprises: a case band having a pipe attachment hole; a winding stem pipe having an off-case band projection that is disposed outside the case band and has outer grooves formed on the outer cylindrical surface, the winding stem pipe inserted into the pipe attachment hole and fixed to the case band in a liquid tight manner; a ring gasket made of elastic resin material that is in close contact with and removably fits on the outer cylindrical surface of the off-case band projection, the gasket restricted in rotation by the outer grooves; a ring that has a male screw formed on the outer cylindrical surface thereof and inner grooves formed on the inner cylindrical surface thereof, the ring removably fitted on the outer cylindrical surface of the gasket such that the gasket is compressed and sandwiched between the ring and the off-case band projection, the ring restricted in rotation by the inner grooves; and a crown that removably engages the male screw.

In the invention, the outer grooves of the off-case band projection and the inner grooves of the ring may be provided only on part of the outer cylindrical surface of the off-case band projection and the inner cylindrical surface of the ring, respectively. For example, it is possible to provide a plurality of sets of grooves spaced apart along the circumferential direction. However, the outer and inner grooves are preferably provided throughout the circumferential surfaces of the off-case band projection and the ring in order to reliably prevent rotation of the gasket with respect to the off-case band projection as well as rotation of the ring with respect to the gasket.

Although the outer and inner grooves may be annular or spiral along the circumferential direction of the off-case band projection and the ring, those grooves preferably extend such that they are inclined to the circumferential direction of the off-case band projection and the ring for more reliably preventing the above-mentioned rotation. As an example, the outer and inner grooves may be formed by knurling. In this case, examples are straight, rightward diagonal, leftward diagonal, or crisscross knurled patterns. Outer and inner grooves with straight knurled pattern will be formed such that they extend in the axial direction of the off-case band projection and the ring. Outer and inner grooves with rightward or leftward diagonal knurled pattern will be formed such that they are inclined to the axial direction of the off-case band projection and the ring. Outer and inner grooves with crisscross knurled pattern will be formed such that they are inclined not only with respect to each other but also to the axial direction of the off-case band projection and the ring.

In the invention, the gasket is made of resin softer than the off-case band projection of the winding stem pipe and the pipe, such as rubber-based or plastic-based elastic material. Examples of plastic-based elastic materials include Tefzel and Terplene (both of which are trade names) or PP (polypropylene).

In the invention, the winding stem pipe is permanently fixed to the case band in a liquid tight manner. The inner cylindrical surface of the gasket, which is compressed between the off-case band projection and the ring, bites into the outer grooves and the outer cylindrical surface of the gasket bites into the inner grooves. Accordingly, the ring that locks the crown through removable engagement between the outer cylindrical surface of the ring and the crown is prevented from rotating with respect to the off-case band projection of the winding stem pipe via the interposing gasket. Not only can the ring be manually removed from the gasket, but also the gasket can be manually removed from the off-case band projection. Therefore, when the screw locking function is impaired due to worn screws resulting from crown rotation for enabling and disabling the screw locking function, the crown, ring, and gasket, at least the ring and gasket, can be replaced, while the winding stem pipe remains fixed to the case band in a liquid tight manner.

In a preferable embodiment of the invention, not only do a plurality of the outer grooves extend in the axial direction of the winding stem pipe and are provided throughout the length of the off-case band projection, but also a plurality of the inner grooves extend in the axial direction of the ring and are provided throughout the length of the ring.

In this preferable embodiment, since the outer and inner grooves are formed such that they orient perpendicular to the rotational direction of the gasket and the ring, the gasket and the ring can be reliably prevented from rotating. Moreover, the direction in which the gasket is pushed such that it fits on the outer cylindrical surface of the off-case band projection coincides with the direction in which the outer grooves extend. Likewise, the direction in which the ring is pushed such that it fits on the outer cylindrical surface of the gasket coincides with the direction in which the inner grooves extend. Thus, when the gasket and the ring are pushed in, the outer and inner grooves will not cause jerky movement of the gasket and the ring, allowing easy attachment of the gasket and the ring.

In a preferable embodiment of the invention, the outer grooves are formed by knurling throughout the outer cylindrical surface of the off-case band projection and the inner grooves are formed by knurling throughout the inner cylindrical surface of the ring.

In this preferable embodiment, the outer grooves formed throughout the inner cylindrical surface of the off-case band projection and the inner grooves formed throughout the inner cylindrical surface of the ring impart projections and recesses to the gasket, which is compressed and sandwiched between the off-case band projection and the ring, throughout the outer and inner cylindrical surfaces of the gasket. This increases the surface area of the gasket to be pressed by the outer cylindrical surface of the off-case band projection and the inner cylindrical surface of the ring, thereby reliably preventing the rotation of the gasket and the ring.

In a preferable embodiment of the invention, inward projections are formed on the inner cylindrical surface of the gasket such that the inward projections and the outer grooves match in number and engage with each other, and outward projections are formed on the outer cylindrical surface of the gasket such that the outward projections and the inner grooves match in number and engaged with each other.

In this preferable embodiment, since the same number of inward and outward projections as the corresponding outer and inner grooves are preformed on the gasket, the gasket can be more easily pushed along the axial direction such that it fits on the outer cylindrical surface of the off-case band projection, and the ring can be more easily pushed along the axial direction such that it fits on the outer cylindrical surface of the gasket, resulting in improved assembling efficiency.

In a preferable embodiment of the invention, the gasket includes a whirl-stop tube that is sandwiched between the off-case band projection and the ring, and a flange that is integrally formed with the whirl-stop tube and sandwiched between the case band and the crown's end closer to the case band.

In this preferable embodiment, during the screwing operation for locking the crown, the flange can prevent the crown's end closer to the case band from sticking to the outer surface of the case band. Therefore, to release the locked crown, initial rotational force on the crown will not be excessively large, resulting in better operational feel.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the invention will be described with reference to FIGS. 1 to 6.

Figure 1:
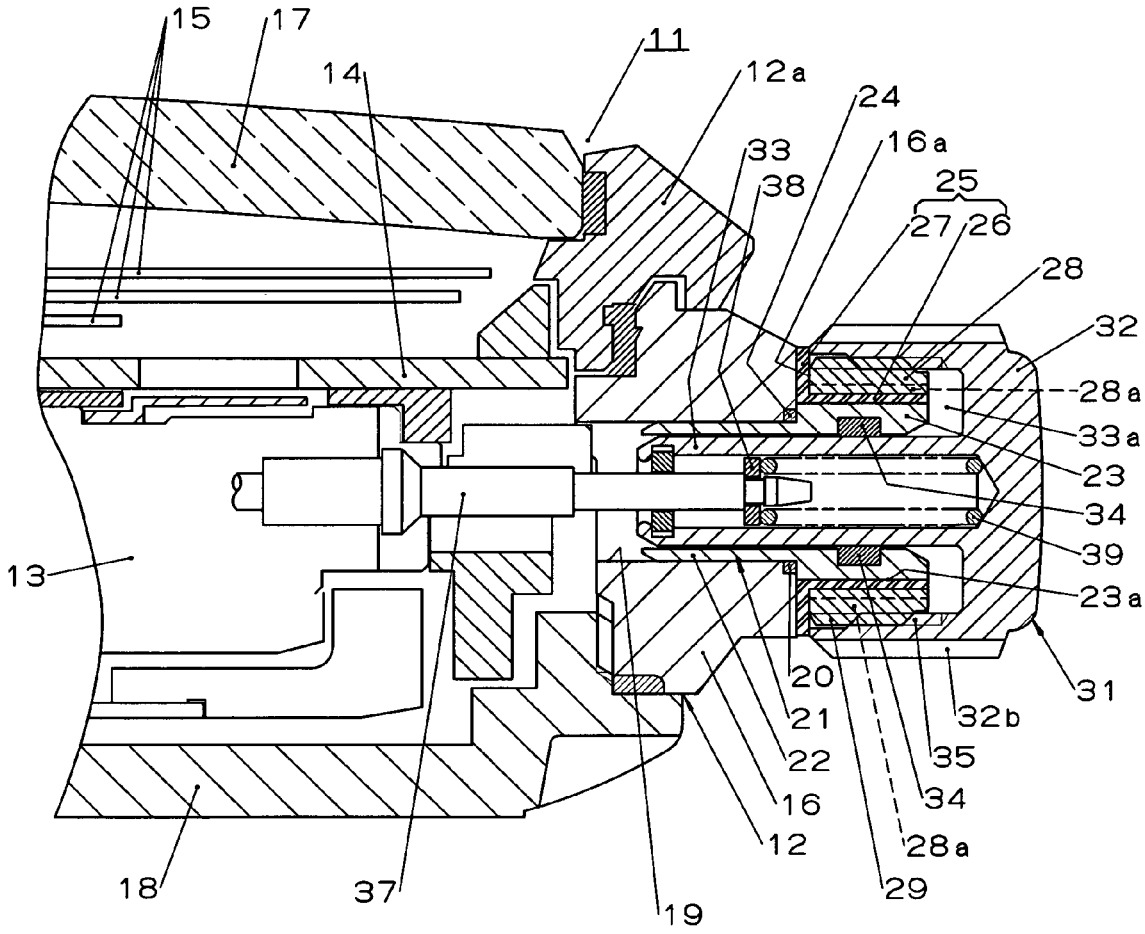
FIG. 1 is a cross-sectional view showing part of the wristwatch according to a first embodiment of the invention.

In FIG. 1, reference number 11 denotes a watch, such as a wristwatch, with a function of screw locking a crown. The wristwatch 11 contains a watch movement 13, a dial 14 and the like in a watch enclosure assembly 12. In FIG. 1, reference number 15 denotes time displaying hands including an hour hand, minute hand, and second hand. The watch movement 13 may be driven by a small battery or a main spring, or may be automatically wound. Alternatively, the watch movement 13 may be adapted to a digital watch in which a quartz oscillator module displays time and the like on the dial 14 in a digital form, or may be a hybrid of a digital watch movement and otherwise.

The watch enclosure assembly 12 is formed of an annular case band 16 made of metal, a cover glass 17 that is attached on one side of the case band 16 with an interposing face bezel 12*a* in the thickness direction in a liquid tight manner, and a rear cover 18 made of metal or the like that is attached on the rear side of the case band 16 in the thickness direction in a liquid tight manner. The dial 14 and the like are visible through the cover glass 17 and the rear cover 18 is removable.

Figure 2:
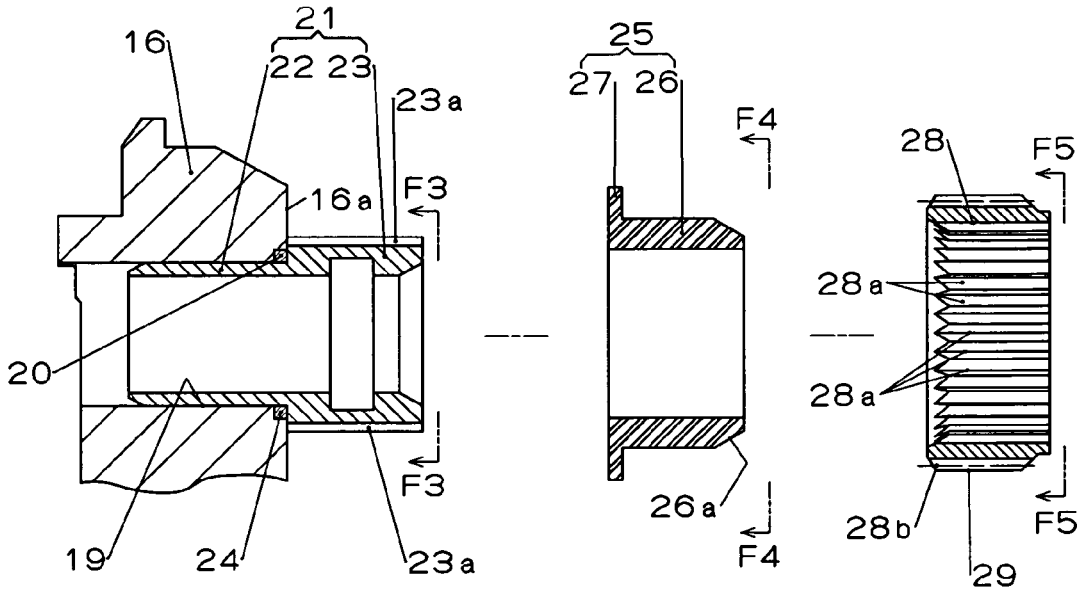
FIG. 2 is a cross-sectional view showing a winding stem pipe attached to a case band of the wristwatch of FIG. 1, and a gasket and a ring disassembled therefrom.
Figure 6:
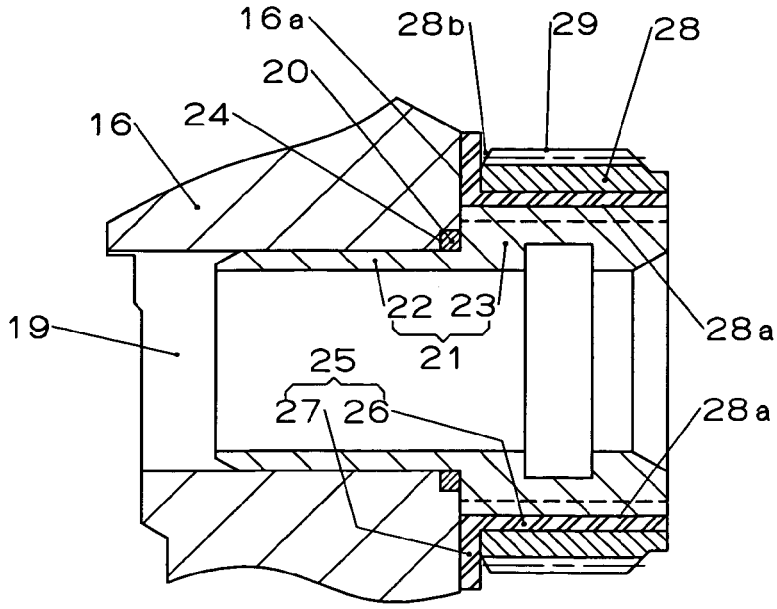
FIG. 6 is a cross-sectional view showing the winding stem pipe attached to the case band of the wristwatch of FIG. 1, and the gasket and the ring assembled therewith.
Figure 7:
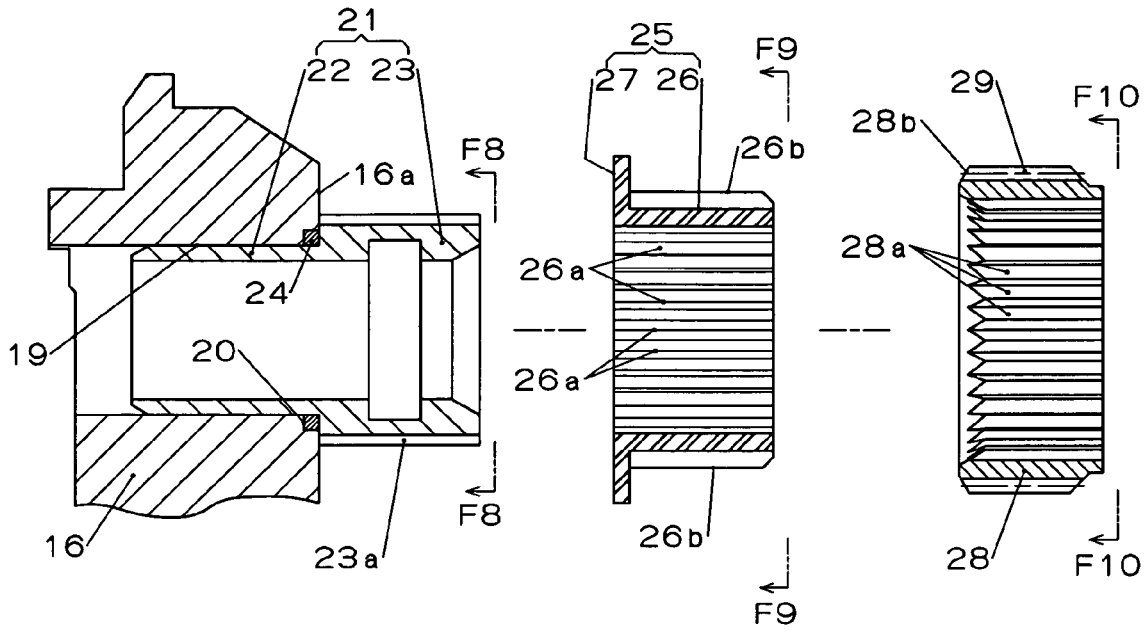
FIG. 7 is a cross-sectional view showing a winding stem pipe attached to a case band of the wristwatch according to a second embodiment of the invention, and a gasket and a ring disassembled therefrom.
Figure 8:
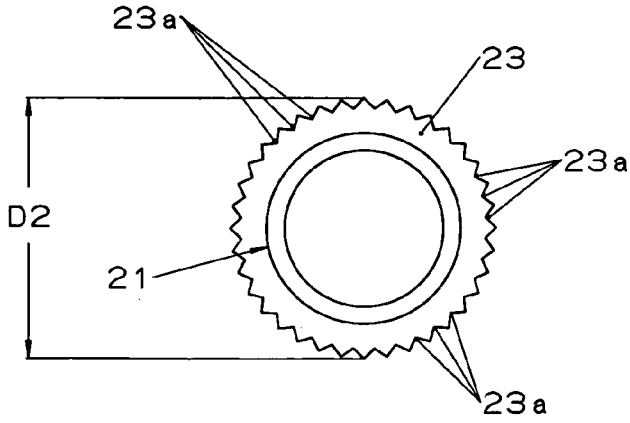
FIG. 8 is a front view showing the winding stem pipe viewed along the line F8-F8 shown in FIG. 7.

As shown in FIGS. 1, 2, and 6, part of the case band 16 is provided with a pipe attachment hole 19 passing through the case band 16 in the radial direction. One end of the pipe attachment hole 19 is open to the interior of the case band, that is, the interior of the watch enclosure assembly 12. The other end of the pipe attachment hole 19 is open to the exterior of the case band, that is, the exterior of the watch enclosure assembly 12. An annular groove 20 with a diameter larger than the pipe attachment hole 19 is formed in the outer surface 16*a* of the case band 16. The annular groove 20 communicates with the case band exterior side opening of the pipe attachment hole 19 and is concentric with this opening.

As shown in FIGS. 1, 2, and 6, a winding stem pipe 21 is inserted into the pipe attachment hole 19 from the outside of the case band and fixed to the case band 16 in a liquid tight manner. The winding stem pipe 21 is made of metal, preferably stainless steel, for example. The winding stem pipe 21 has an insert portion 22 that forms one side of the pipe and an off-case band projection 23 that forms the other side of the pipe. The insert portion 22 is a portion that is inserted in the pipe attachment hole 19 from the outside of the case band, for example, in a press-fitting manner to some degree. The off-case band projection 23 is a portion that is disposed outside the case band 16 and has a diameter larger than both the outer diameter of the insert portion 22 and the diameter of the annular groove 20.

Figure 3:
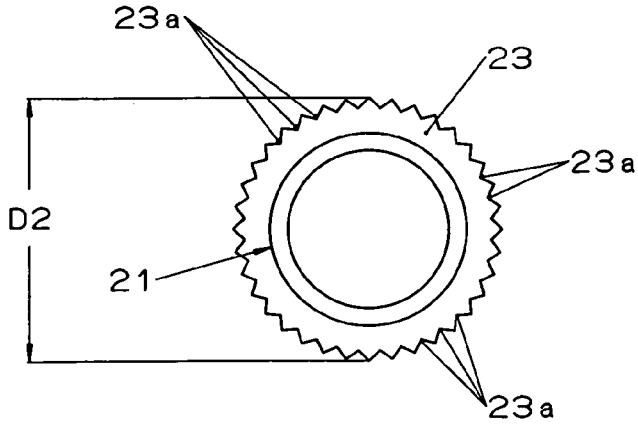
FIG. 3 is a front view showing the winding stem pipe viewed along the line F3-F3 shown in FIG. 2.
Figure 4:
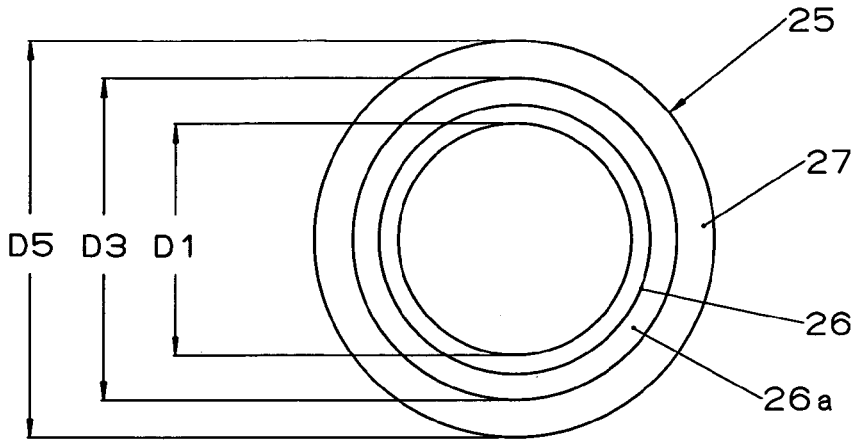
FIG. 4 is a front view showing the gasket viewed along the line F4-F4 shown in FIG. 2.

A plurality of outer grooves 23*a* are formed on the outer cylindrical surface of the off-case band projection 23 that is integral with the insert portion 22 with a stepped portion therebetween. As a preferable example, the outer grooves 23*a* extend throughout the length of the off-case band projection 23 in the axial direction of the winding stem pipe 21 as shown in FIGS. 2 and 6, and are disposed along the circumferential direction of the off-case band projection 23 with a predetermined interval as shown in FIG. 3. By providing these outer grooves 23*a*, the outer cylindrical surface of the off-case band projection 23 is imparted with projections and recesses. The outer grooves 23*a* are, for example, straight knurled portions by knurling the outer cylindrical surface of the off-case band projection 23. Knurling may be performed either by machining or drawing.

The winding stem pipe 21 is permanently fixed to the case band 16 using a metal brazing material 24 filled in the annular groove 20 by first inserting the insert portion 22 of the winding stem pipe 21 in the pipe attachment hole 19 until the off-case band projection 23 touches the outer surface of the case band 16*a*. The brazing material 24 for fixing the winding stem pipe 21 also serves as a liquid tight member that ensures watertightness between the case band 16 and the winding stem pipe 21. In this embodiment, although the insert portion 22 is shorter than the pipe attachment hole 19, the insert portion 22 may be longer than the pipe attachment hole 19.

A gasket 25 removably fits on the off-case band projection 23. The gasket 25 is made of elastically deformable resin material such as elastic plastic, specifically polypropylene, and shaped into a ring. The gasket 25 includes a whirl-stop tube 26 and a flange 27 integrally formed therewith. The overall length (axial length) of the gasket 25 is the same as the overall length (axial length) of the off-case band projection 23.

The inner diameter D1 of the whirl-stop tube 26 before the gasket 25 is attached to the off-case band projection 23, i.e., when it is free from any restrictions (see FIG. 4), is smaller than the outer diameter D2 of the off-case band projection 23 (see FIG. 3). Likewise, the outer diameter D3 of the whirl-stop tube 26, when gasket 25 is free from any restrictions (see FIG. 4), is larger than the inner diameter D4 of a ring that will be described later (see FIG. 5). On the outer cylindrical surface at the end of the whirl-stop tube 26, which is the opposite end to the flange 27, is formed a tapered surface 26*c*, which gradually decreases the outer diameter of that end. The flange 27 is formed such that it projects outwardly and its diameter D5 (see FIG. 4) is larger than the outer diameters D1 to D4.

As shown in FIGS. 1 and 6, the gasket 25 is attached to the off-case band projection 23 such that the whirl-stop tube 26 fits on the outer cylindrical surface of the off-case band projection 23 and the flange 27 abuts the outer surface of the case band 16*a*. This attachment is performed by orienting the flange 27 toward the off-case band projection 23 and pushing the whirl-stop tube 26 thereon with the whirl-stop tube 26 elastically deformed. Conversely, by firmly pulling the gasket 25, the gasket 25 can be removed from the off-case band projection 23.

Figure 5:
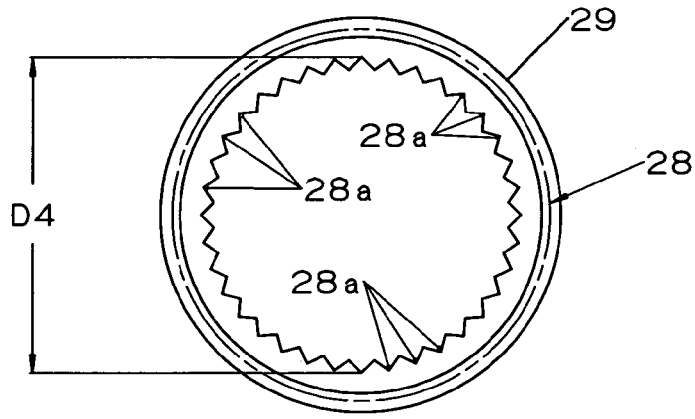
FIG. 5 is a front view showing the ring viewed along the line F5-F5 shown in FIG. 2.

A ring 28 that serves as a dummy member removably fits on the outer cylindrical surface of the gasket 25 that is attached to the off-case band projection 23. The ring 28 is made of metal, preferably stainless steel, for example. The ring 28 has approximately the same length as the off-case band projection 23 and has a male screw 29 for screw locking formed on the outer cylindrical surface, as shown in FIGS. 2 and 5.

A plurality of inner grooves 28*a* is formed on the inner cylindrical surface of the ring 28. As a preferable example, the inner grooves 28*a* extend throughout the length of the ring 28 in the axial direction as shown in FIGS. 2 and 5 and are disposed along the circumferential direction of the ring 28 with a predetermined interval. By providing these inner grooves 28*a*, the inner cylindrical surface of the ring 28 is imparted with projections and recesses. The inner grooves 28*a* are, for example, straight knurled portions by knurling the inner cylindrical surface of the ring 28. Examples of knurling include drawing. Reference number 28*b* in FIGS. 2 and 6 denotes a tapered surface for prying the ring 28, which also serves as a chamfer of the male screw 29.

The ring 28 is attached to the outer cylindrical surface of the gasket 25 in a press-fitting manner by orienting the end having the tapered surface 28*b* toward the gasket 25 and firmly pushing the ring 28 until that end hits the flange 27 (FIG. 6 shows the resulting assembly). Conversely, by firmly pulling the ring 28, the ring 28 can be removed from the gasket 25.

When the ring 28 fits on the gasket 25, the gasket 25 is further elastically deformed according to the difference in dimension of D3 and D4 and sandwiched between the off-case band projection 23 and the ring 28 in a compressed manner. In this way, not only does the inner cylindrical surface of the gasket 25 bite into the respective outer grooves 23*a* of the off-case band projection 23 and the gasket 25 is pressed on the outer cylindrical surface of the off-case band projection 23, but also the outer cylindrical surface of the gasket 25 bites into the respective inner grooves 28*a* of the ring 28 and the gasket 25 is pressed on the inner cylindrical surface of the ring 28.

Frictional force due to such pressing prevents the gasket 25 from rotating in the circumferential direction of the off-case band projection 23 as well as the ring 28 from rotating in the circumferential direction of the gasket 25. Furthermore, the frictional force reliably holds the ring 28 against the biasing force of a coil spring 39, which will be described later, and prevents the ring 28 from being pulled out from the outer cylindrical surface of the off-case band projection 23 in the axial direction.

In this case, as the outer grooves 23*a* shaped by knurling are formed throughout the outer cylindrical surface of the off-case band projection 23 and the inner grooves 28*a* shaped by knurling are formed throughout the inner cylindrical surface of the ring 28, the gasket 25 compressed and sandwiched between the off-case band projection 23 and the ring 28 is imparted with projections and recesses over its cylindrical surfaces. This increases the surface area of the gasket 25 to be pressed by the outer cylindrical surface of the off-case band projection 23 and the inner cylindrical surface of the ring 28. Therefore, the gasket 25 and the ring 28 are reliably prevented from rotating. Moreover, the outer and inner grooves 23*a* and 28*a* are formed such that they orient perpendicular to the rotational direction of the gasket 25 and the ring 28. This also assists in reliably preventing the rotation of the gasket 25 and the ring 28.

Furthermore, the direction in which the gasket 25 is pushed such that it fits on the outer cylindrical surface of the off-case band projection 23 coincides with the direction in which the outer grooves 23*a* extend. Likewise, the direction in which the ring 28 is pushed such that it fits on the outer cylindrical surface of the gasket 25 coincides with the direction in which the inner grooves 28*a* extend. Thus, when the gasket 25 and the ring 28 are pushed for attachment, the outer and inner grooves 23*a* and 28*a* will not cause jerky movement of the gasket 25 and the ring 28, allowing the gasket 25 and the ring 28 to easily fit on the off-case band projection 23 in sequence.

In FIG. 1, reference number 31 denotes a crown made of metal. The crown 31 has a crown main portion 32 and a crown tube 33 that is integrally formed with the crown main portion 32 and protrudes from the center thereof toward the rear side.

The crown tube 33 is inserted into the insert portion 22 such that the crown tube 33 is movable in the axial direction thereof. Watertightness between the crown tube 33 and the insert portion 22 is achieved by a watertight annular rubber gasket 34 attached to either the crown tube 33 or the insert portion 22, for example, to the insert portion 22. The watertight gasket 34 is compressed, elastically deformed, and sandwiched between the inner cylindrical surface of the winding stem pipe 21 and the outer cylindrical surface of the crown tube 33.

The crown main portion 32 has an annular groove 33*a* that surrounds the bottom part of the crown tube 33. The annular groove 33*a* is a portion that accommodates the off-case band projection 23 with the ring 28 attached thereto. On the outer cylindrical surface of the crown main portion 32 are formed straight knurled grooves 32*b* that serve to prevent the fingers from slipping when they rotate the crown 31. On the inner cylindrical surface of the crown main portion 32 is formed a female screw 35 for the purpose of screw locking. The female screw 35 removably engages the male screw 29 of the ring 28. Using the fingers to hold the crown main portion 32 of the crown 31 to rotate the crown 31 in the tightening direction widens the portion where the female screw 35 and the male screw 29 engage with each other. Conversely, rotating the crown 31 in the loosening direction allows disengagement of the screws.

By rotating the crown 31 in the tightening direction, the crown main portion 32 closely abuts the flange 27 that is mounted on the outer surface 16*a* of the case band 16 as shown in FIG. 1. This close abutment functions to lock the screws and prevents accidental rotation of the crown 31 when the wristwatch 11 is worn on the wrist. The flange 27 of the gasket 25 may be omitted and, in this case, the crown main portion 32 closely abuts the outer surface 16*a* of the case band 16 for screw locking.

As shown in FIG. 1, in the crown tube 33, not only is a winding stem 37 inserted outwardly from the inside of the case band 16, but also a spring catch 38 provided as a support of the winding stem 37 and a biasing member, such as a coil spring 39, that is supported at one end by the spring catch 38 and biases the crown 31 outward with respect to the case band 16 are accommodated. After the female screw 35 is disengaged from the male screw 29, in other words, after the screw locking is released, the watch movement 13 is rotated in cooperation with the rotation of the crown 31. In this way, time correction or the like is performed.

After some operations using the crown, to attach the crown 31 to the off-case band projection 23 for screw locking, the crown tube 33 may be pushed in the winding stem pipe 21 from the outside of the case band 16 while the winding stem 37 remains connected with the crown tube 33, and the female screw 35 of the crown main portion 32 is screwed in the male screw 29 of the ring 28 in the tightening direction. With the crown 31 screwed on the male screw 29 all the way through its travel, the flange 27 of the gasket 25 is compressed and sandwiched between the crown main portion 32 and the outer surface 16*a* of the case band 16, and the crown main portion 32 caps the ring 28 and the off-case band projection 23 to which the ring 28 is attached.

During the screwing operation of the crown 31 for locking itself as mentioned above, the flange 27 of the gasket 25 prevents the end of the crown 31 that is closer to the case band 16 from sticking to the outer surface 16*a* of the case band 16. Additionally, the flange 27 is made of synthetic resin and, in particular, frictional resistance between polypropylene and metal is smaller than that between the metal case band 16 and the metal crown 31. Therefore, to release the locked crown 31, initial rotational force on the crown 31 will not be excessively large, resulting in better operational feel.

With the crown 31 thus attached, watertightness under high pressure can be achieved and maintained as described below. That is, watertightness between the winding stem pipe 21 and the case band 16 is achieved by the brazing material 24 used to fix them, and watertightness between the winding stem pipe 21 and the crown tube 33 inserted therein is achieved by the compressed and elastically deformed watertight gasket 34 sandwiched therebetween. Furthermore, the compressed and sandwiched flange 27 prevents water, sandy dust and the like from entering the portion where the male screw 29 and the female screw 35 engage with each other.

Since the crown 31 is screw locked when the watch 11 is worn on the wearer's body as described above, accidental rotation of the crown 31 and corresponding accidental time display setting change or the like can be prevented. To perform time correction or the like, the crown 31 is rotated in the opposite direction to the one when the crown 31 is screw locked, and the crown main portion 32 is disengaged from the male screw 29 of the ring 28 to pull the crown 31 out against the force of the coil spring 43.

When the screws are damaged or worn due to the rotation of the crown 31 and hence the screw locking function of the crown 31 is impaired, replacing parts can fix the problem, as described below.

Firstly, the crown 31 is removed from the case band 16. Then, the tip of a tool (not shown) is inserted in the wedge-like gap between the flange 27 that is mounted on the outer surface 16*a* of the case band and the end of the ring 28 that abuts the flange 27 (this gap is created by providing the tapered surface 28*b* to the ring 28). Subsequently, the inserted tip of the tool pries the ring 28, while a sufficient force to remove it is applied, to remove the ring 28 from the outer cylindrical surface of the off-case band projection 23 of the winding stem pipe 21.

The ring 28 is removed while the winding stem pipe 21 is remained brazed and fixed to the case band 16. In this case, the gasket 25 protects the outer surface 16*a* of the case band and the off-case band projection 23 from being hit and damaged by the tool when it pries the ring 28.

Then, the gasket 25 is removed from the off-case band projection 23 by elastically deforming the gasket 25. Here, the flange 27 facilitates the removing operation of the gasket 25 since the gasket 25 can be removed by grabbing the flange 27. Alternatively, to remove the gasket 25, a cutter may be used to cut the gasket 25 at any suitable location to break it away.

When the gasket 25 is made of plastic, it gives the following advantages against a metal gasket. In a configuration in which a metal ring 28 closely presses and elastically deforms a metal gasket, frictional force between the ring 28 and the metal gasket tends to be inconsistent due to variation in peripheral margin of the gasket, resulting in difficulty providing proper frictional force. Excessive frictional force may lead to abnormally large resistance to the removal of the ring 28 and even failure of removal of the ring 28. Conversely, insufficient frictional force may fail to reliably prevent ring rotation. In contrast, since a plastic gasket 25 is much easily elastically deformed than its metal counterpart, use of a plastic gasket is practical to easily establish proper frictional force between the ring 28 and the gasket 25 despite variation in peripheral margin of the gasket 25.

Next, a new gasket 25 and ring 28 prepared as replacement parts are pushed such that they are attached in a press-fit manner to the outer cylindrical surface of the off-case band projection 23 of the winding stem pipe 21 as described above, and then the crown 31 is attached to the ring 28 by engaging them with each other. In this case, the crown 31 may also be replaced as required.

As described above, when the screw locking function is impaired, the gasket 25, the ring 28 and the like can be replaced with new ones while the winding stem pipe 21 is remained brazed and fixed to the case band 16. Thus, in repairing impaired screw locking function, the watertightness between the case band 16 and the winding stem pipe 21 will not be compromised or a new action for watertightness will not be required. Therefore, not only can initial quality of watertightness be maintained for a long period of time, but also for a customer who requests repair, the entire watch enclosure assembly 12 including the case band 16 is not required to be replaced, but part replacement can fix the problem, resulting in decreased cost.

In the above repair of impaired screw locking function, it may be advantageous to prepare multiple kinds of new replacement rings 28 that have a common shape but differ in diameter, pitch, the number of screw heads and the like of the male screw 29, as well as multiple kinds of crowns 31 that have female screws respectively mating with those male screws 29. In this way, the ring 28 and the crown 31 that have been damaged by use and will be discarded may not necessarily be replaced with the same ones, but may be replaced with a new pair of ring 28 and crown 31 selected from any of the above multiple kinds of rings and crowns. This eliminates the need to store replacement parts for a long period of time, allowing easier part management on the manufacturer's side.

FIGS. 7 to 11 show a second embodiment of the invention. Because the second embodiment is similar to the first embodiment except the items to be described below, the configurations that are the same as those of the first embodiment have the same reference numerals and their explanations will be omitted.

Figure 9:
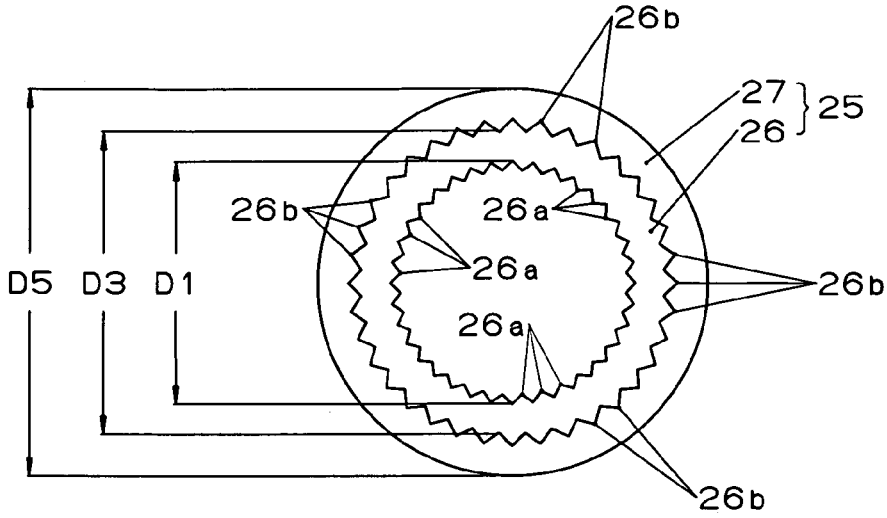
FIG. 9 is a front view showing the gasket viewed along the line F9-F9 shown in FIG. 7.
Figure 10:
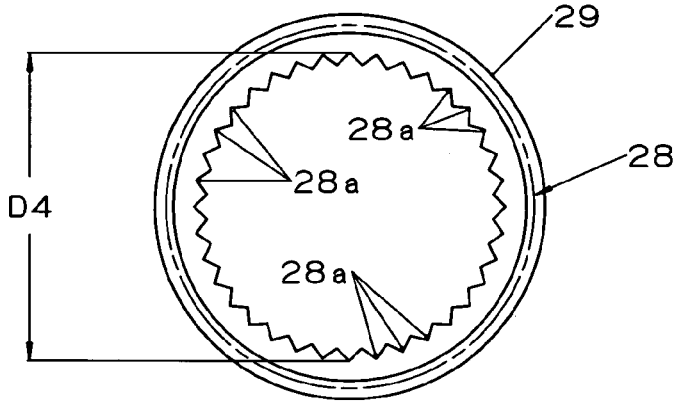
FIG. 10 is a front view showing the ring viewed along the line F10-F10 shown in FIG. 7.
Figure 11:
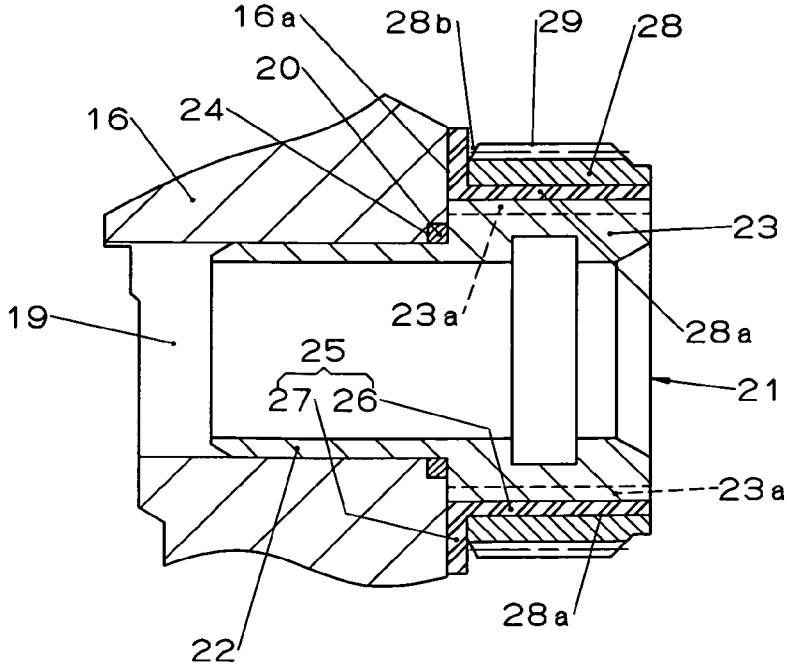
FIG. 11 is a cross-sectional view showing the winding stem pipe attached to the case band of the wristwatch according to a second embodiment of the invention, and the gasket and ring assembled therewith.

In the second embodiment, the whirl-stop tube 26 of the gasket 25 is shaped such that it has wavy surfaces formed of continuous projections and recesses in the circumferential direction, as shown in FIG. 9. Specifically, the inner cylindrical surface of the whirl-stop tube 26 compressed and sandwiched between the off-case band projection 23 and the ring 28 has a plurality of inward projections 26*a* disposed along the circumferential direction with a predetermined interval. Likewise, the outer cylindrical surface of the whirl-stop tube 26 has a plurality of outward projections 26*b* disposed along the circumferential direction with a predetermined interval. These inward projections 26*a* and the outward projections 26*b* are displaced in the circumferential direction. The number and size of the inward projections 26*a* correspond to those of the outer grooves 23*a* of the off-case band projection 23, for example, the same in number. Thus, the gasket 25 fits on the outer cylindrical surface of the off-case band projection 23 such that those inward projections 26*a* engage the outer grooves 23*a*. Similarly, the number and size of the outward projections 26*b* correspond to those of the inner grooves 28*a* of the ring 28, for example, the same in number. Thus, the ring 28 fits on the outer cylindrical surface of the gasket 25 such that those outward projections 26*b* engage the inner grooves 28*a*. This embodiment is the same as the first embodiment including the items not shown except the items described above.

Therefore, the second embodiment provides similar advantages to the first embodiment and can solve the problem that the invention addresses. In addition, since the gasket 25 has the same number of inward projections 26*a* and outward projections 26*b* as the corresponding outer grooves 23*a* and inner grooves 28*a*, the gasket 25 is more easily pushed along the axial direction such that it fits on the outer cylindrical surface of the off-case band projection 23, and the ring 28 is more easily pushed along the axial direction such that it fits on the outer cylindrical surface of the gasket 25, resulting in improved assembling efficiency.

The invention is not limited to the above embodiments, but is applicable to watches such as ordinary wristwatches that do not require watertightness under high pressure, pocket watches, necklace type hanging watches. The gasket is not necessarily a separate member from the ring, but may be mounted into the inner cylindrical surface of the ring by insert molding. This arrangement is preferable in that the number of parts required for assembling can be reduced.

According to the invention, there is provided a watch in which the crown and associated parts, excluding the winding stem pipe, can be replaced when the screw locking function is impaired.

What is claimed is:

1. A watch comprising:

a case band having a pipe attachment hole;

a winding stem pipe having an off-case band projection that is disposed outside the case band and has outer grooves formed on the outer cylindrical surface, the winding stem pipe inserted into the pipe attachment hole and fixed to the case band in a liquid tight manner;

a ring gasket made of elastic resin material that is in close contact with and removably fits on the outer cylindrical surface of the off-case band projection, the gasket restricted in rotation by the outer grooves;

a ring that has a male screw formed on the outer cylindrical surface and inner grooves formed on the inner cylindrical surface, the ring removably fitted on the outer cylindrical surface of the gasket such that the gasket is compressed and sandwiched between the ring and the off-case band projection, the ring restricted in rotation by the inner grooves; and a crown that removably engages the male screw.

2. A watch according to claim 1, wherein a plurality of the outer grooves extend in the axial direction of the winding stem pipe and are provided throughout the length of the off-case band projection, and a plurality of the inner grooves extend in the axial direction of the ring and are provided throughout the length of the ring.

3. A watch according to claim 2, wherein the outer grooves are formed by knurling throughout the outer cylindrical surface of the off-case band projection and the inner grooves are formed by knurling throughout the inner cylindrical surface of the ring.

4. A watch according to claim 1, wherein inward projections are formed on the inner cylindrical surface of the gasket such that the inward projections and the outer grooves match in number and engage with each other, and outward projections are formed on the outer cylindrical surface of the gasket such that the outward projections and the inner grooves match in number and engage with each other.

5. A watch according to claim 1, wherein the gasket includes a whirl-stop tube that is sandwiched between the off-case band projection and the ring, and a flange that is integrally formed with the whirl-stop tube and sandwiched between the case band and the crown's end closer to the case band.

* * * * *